US008015753B2

(12) United States Patent
Bachman

(10) Patent No.: US 8,015,753 B2
(45) Date of Patent: Sep. 13, 2011

(54) GUTTER COVER WITH BARRIER OVER WATER CHANNEL

(75) Inventor: James E. Bachman, Omaha, NE (US)

(73) Assignee: Eran Industries, Inc., Omaha, NE (US)

( * ) Notice: Subject to any disclaimer, the term of this patent is extended or adjusted under 35 U.S.C. 154(b) by 492 days.

(21) Appl. No.: 12/174,432

(22) Filed: Jul. 16, 2008

(65) Prior Publication Data

US 2009/0019786 A1 Jan. 22, 2009

Related U.S. Application Data

(60) Provisional application No. 60/990,490, filed on Nov. 27, 2007, provisional application No. 60/954,491, filed on Aug. 7, 2007, provisional application No. 60/949,913, filed on Jul. 16, 2007.

(51) Int. Cl.
*E04D 13/064* (2006.01)

(52) U.S. Cl. ..... 52/12; 52/15; 248/48.1

(58) Field of Classification Search ..... 52/11–15, 52/173.3; 248/48.1, 48.2; 249/48.2
See application file for complete search history.

(56) References Cited

U.S. PATENT DOCUMENTS

| | | | | |
|---|---|---|---|---|
| 6,098,344 | A * | 8/2000 | Albracht | 52/12 |
| 6,944,991 | B2 * | 9/2005 | Kim | 52/11 |
| 7,104,012 | B1 * | 9/2006 | Bayram | 52/12 |
| 2003/0046876 | A1 * | 3/2003 | Higginbotham | 52/11 |
| 2005/0034377 | A1 * | 2/2005 | Willert | 52/11 |
| 2006/0196124 | A1 * | 9/2006 | Bachman | 52/12 |
| 2007/0094939 | A1 * | 5/2007 | Bachman | 52/11 |

* cited by examiner

*Primary Examiner* — Jeanette E. Chapman
(74) *Attorney, Agent, or Firm* — Hovey Williams LLP

(57) ABSTRACT

The gutter cover to be utilized with a gutter that is attached to a building below a roof comprises a first section, a second section, a third section, a fourth section, a water channel, and a barrier. The first section may be installed over or under roofing material. The second section may be coupled to the first section and generally overlies the open portion of the gutter. The third section may be coupled to the second and may include a hem along the length of the gutter cover. The fourth section may be coupled to the third section and may include cutouts for water to drain into the gutter. A lip may also be coupled to the fourth section and may engage the upper front portion of the gutter. The water channel may be formed between the third section and the lip. The barrier may couple with the hem to cover the water channel and allow water to flow into the channel while blocking debris from entering the water channel.

10 Claims, 8 Drawing Sheets

GUTTER COVER WITH BARRIER OVER WATER CHANNEL

RELATED APPLICATIONS

The present application claims priority benefit to the following U.S. provisional patent applications: "GUTTER COVER WITH SCREEN OVER WATER CHANNEL", Ser. No. 60/949,913, filed Jul. 16, 2007; "GUTTER COVER WITH SCREEN OVER WATER CHANNEL", Ser. No. 60/954,491, filed Aug. 7, 2007; "GUTTER COVER WITH VERTICAL BARS", Ser. No. 60/990,490, filed Nov. 27, 2007. The listed provisional applications are incorporated into the present application by reference, in their entirety.

BACKGROUND OF THE INVENTION

1. Field of the Invention

Embodiments of the present invention relate to gutter covers. More particularly, embodiments of the present invention relate to gutter covers that include a barrier to prevent debris from falling into a water channel.

2. Description of the Related Art

Gutters are often installed on houses and other buildings to collect and carry water away from roofs and other sloped surfaces. Unfortunately, gutters often become clogged with leaves, twigs, and other debris, thus limiting their ability to collect and divert water. Clogged gutters can also overflow, causing water damage to fascia and soffits of the buildings to which they are attached. Gutter covers, such as the ones described in U.S. Pat. Nos. 5,557,891; 5,660,001; and 6,098,344 have been developed to alleviate these problems. Some gutter covers described in these patents have water channels for directing rainwater to their gutters, but even these water channels can become clogged with leaves, twigs, and other debris.

SUMMARY OF THE INVENTION

Embodiments of the present invention solve the above-mentioned problems and provide a distinct advance in the art of gutter covers. More particularly, embodiments of the invention provide a gutter cover with a barrier over a water channel to prevent clogging of the gutter as well as the gutter cover water channel.

An exemplary gutter cover, constructed in accordance with various embodiments of the present invention, comprises a first section, a second section, a third section, a fourth section, a water channel, and a barrier. The first section may be installed over or under roofing material to retain the gutter cover in position over the gutter. The second section may be coupled to the first section and generally overlies the open portion of the gutter. The third section may be coupled to the second and may include a hem along the length of the gutter cover. The hem may include an open-space cavity. The fourth section may be coupled to the third section and may include cutouts for water to drain into the gutter. A lip may also be coupled to the fourth section and may engage the upper front portion of the gutter. The water channel may be formed between the third section and the lip. The barrier may couple with the hem to cover the water channel and may include a crown that is slidably installed in the open-space cavity to retain the barrier in position. The barrier generally allows water to flow into the channel while blocking debris from entering the water channel. The barrier may include a screen structure or a comb-shaped structure.

Another embodiment of the gutter cover may include components substantially similar as above, with the exception that the hem may include a pocket with a generally U-shaped cross section. The barrier is coupled with the hem by inserting a crown of the barrier into the pocket such that the hem retains the barrier. The barrier may include the screen structure or the comb-shaped structure.

Another embodiment of the gutter cover may include components substantially similar as above, with the exception that the third section may include a plurality of longitudinally spaced apart holes. The barrier with the comb-shaped structure, which includes a plurality of teeth, may be coupled with the third section to cover the water channel by inserting the teeth through the holes of the third section.

This summary is provided to introduce a selection of concepts in a simplified form that are further described below in the detailed description. This summary is not intended to identify key features or essential features of the claimed subject matter, nor is it intended to be used to limit the scope of the claimed subject matter.

Other aspects and advantages of the present invention will be apparent from the following detailed description of the embodiments and the accompanying drawing figures.

BRIEF DESCRIPTION OF THE DRAWING FIGURES

Embodiments of the present invention is described in detail below with reference to the attached drawing figures, wherein.

Figure 1:
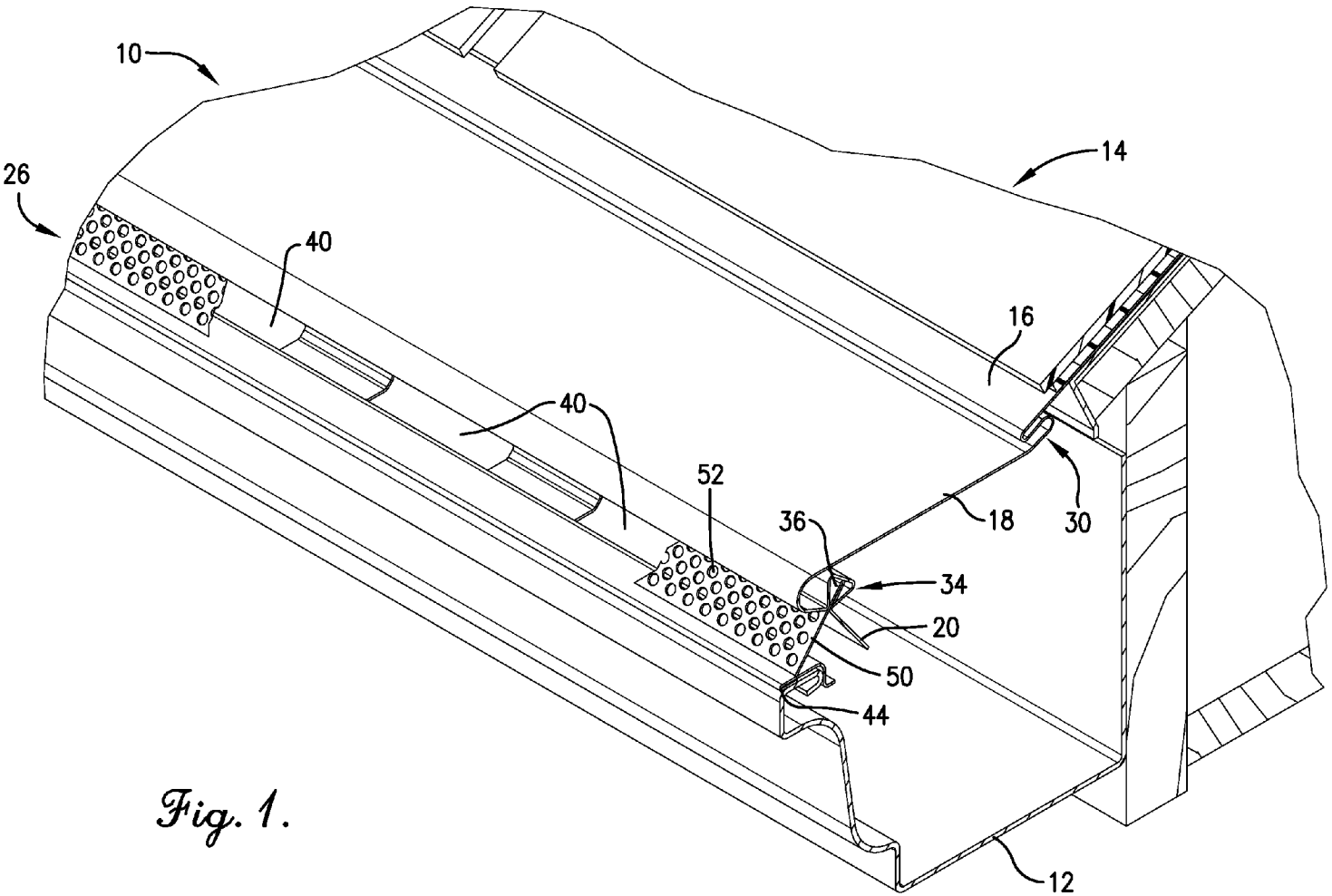
FIG. 1 is a perspective view of a gutter cover, constructed in accordance with various embodiments of the present invention, shown covering a gutter attached under a roof and also shown with a barrier that includes a screen.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

As illustrated in the attached FIGS. 1, 3, 6, 7, and 10, the gutter cover 10 is adapted to be installed over a gutter 12 attached below a roof 14 or other sloped surface of a building and collects water from the roof 14 and directs it into the gutter 12 while preventing leaves and other debris from entering the gutter 12. The gutter cover 10 may be of various shapes and sizes to fit over different sizes and styles of gutters. Examples of gutter covers are described in detail in U.S. Pat. Nos. 5,557,891; 5,660,001; and 6,098,344, all incorporated into the present application by reference.

The gutter cover 10, as constructed in accordance with various embodiments of the present invention, comprises a first section 16, a second section 18, a third section 20, a fourth section 22, a water channel 24, and a barrier 26. In general, the gutter cover 10 may be formed from a number of individual segments which can be interconnected to cover any length of gutter 12. In one embodiment, each segment is approximately four feet long and includes one end which can slide into an end of an adjacent segment so a plurality of segments can be interconnected to cover a long length of gutter 12 without the use of screws, brackets, or other fasteners joining the segments together. Each gutter cover 10 segment is preferably formed from a single piece of aluminum or other suitable material which is bent into the configuration shown in the drawing figures. If the gutter cover 10 is formed of aluminum, the preferred thickness of each segment is preferably between 1/32" and 1/16".

As best illustrated FIGS. 1, 3, 6, and 9, the first section 16 is generally planar and is adapted to be installed under a first row of shingles on the roof 14 without the use of nails, screws, staples or other fasteners. Alternatively, the first section 16 may be secured over the shingles or other covering on the roof 14. The first section 16 slopes downwardly from right to left when viewed from the perspective of Fig. so as to match the pitch of the roof 14. The angle of the first section 16 can be changed as described in the above-referenced patents to match the slope of the roof 14 or other sloped surface to which it is attached. The first section 16 may include a first lip 28 formed by a generally 180° bend in its rightmost end. The first lip 28 resists movement of the first section 16 once it is installed under the roof shingles.

The generally planar second section 18 is joined to the first section 16 by a first bend 30. The second section 18 is adapted to overlie the open end of the gutter 12 when installed and slopes gradually from right to left so as to direct water away from the roof 14, over the left edge of the second section 18, and into the gutter 12.

The first bend 30 is generally S-shaped in cross section and performs several important functions. First, it permits the angle of the first section 16 to be adjusted relative to the second section 18 so as to match the pitch of the roof 14. Second, the first bend 30 slows the flow of water from the roof 14 to the second section 18 by reversing the water flow through capillary action. Through capillary action, water flowing over the first bend 30 follows along the surface of the first bend 30 and reverses direction rather than spilling over the bend.

The third section 20 is joined to the second section 18 by a second bend 32. The second bend 32 preferably has an obtuse angle so that the third section 20 slopes downwardly and inwardly relative to the leftmost edge of the second section 18. As with the first bend 30, the second bend 32 and the third section 20 serve to reverse and slow the flow of water over the gutter cover 10 through capillary action.

The third section 20 includes a hem 34 that includes an open-spaced cavity 36 for receiving and retaining the barrier 26 as discussed in more detail below. The cavity 36 may be formed on the rear side of the third section 20, wherein the rear side is that side of the third section 20 that faces the interior of the gutter 12. The cavity 36 may have a variety of cross-sectional shapes including generally circular, generally oval, generally elliptical, or generally triangular. FIGS. 1-4 illustrate the cavity 36 with a generally triangular cross section. The cavity 36 is formed by bending the third section 20 one of more times to create the desired cross-sectional shape. Furthermore, the hem 34 includes a gap 38 at the base of the cavity 36 to accommodate the barrier 26, also discussed in more detail below.

Figure 3:
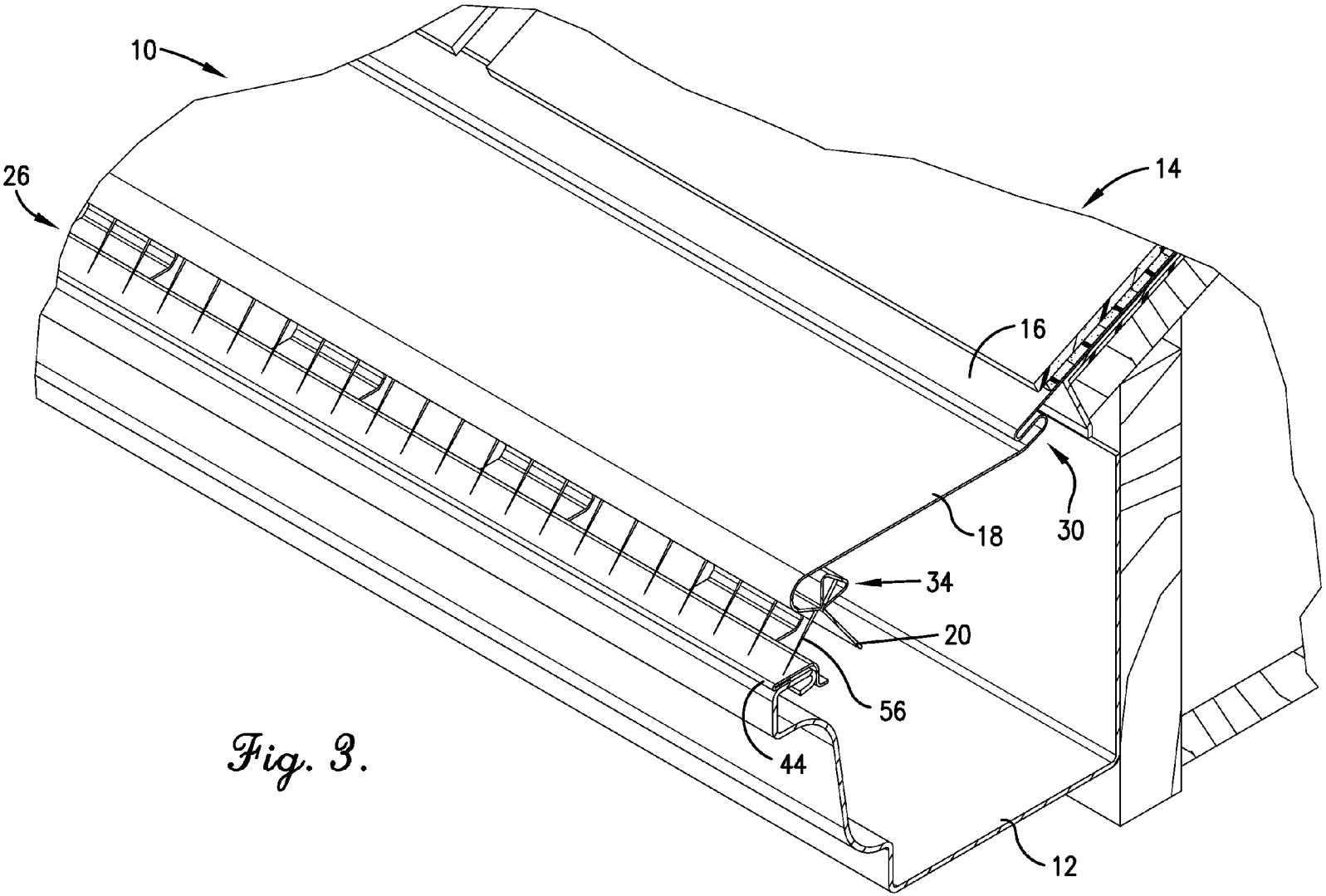
FIG. 3 is a perspective view of the gutter cover shown with a barrier that includes a comb structure.
Figure 6:
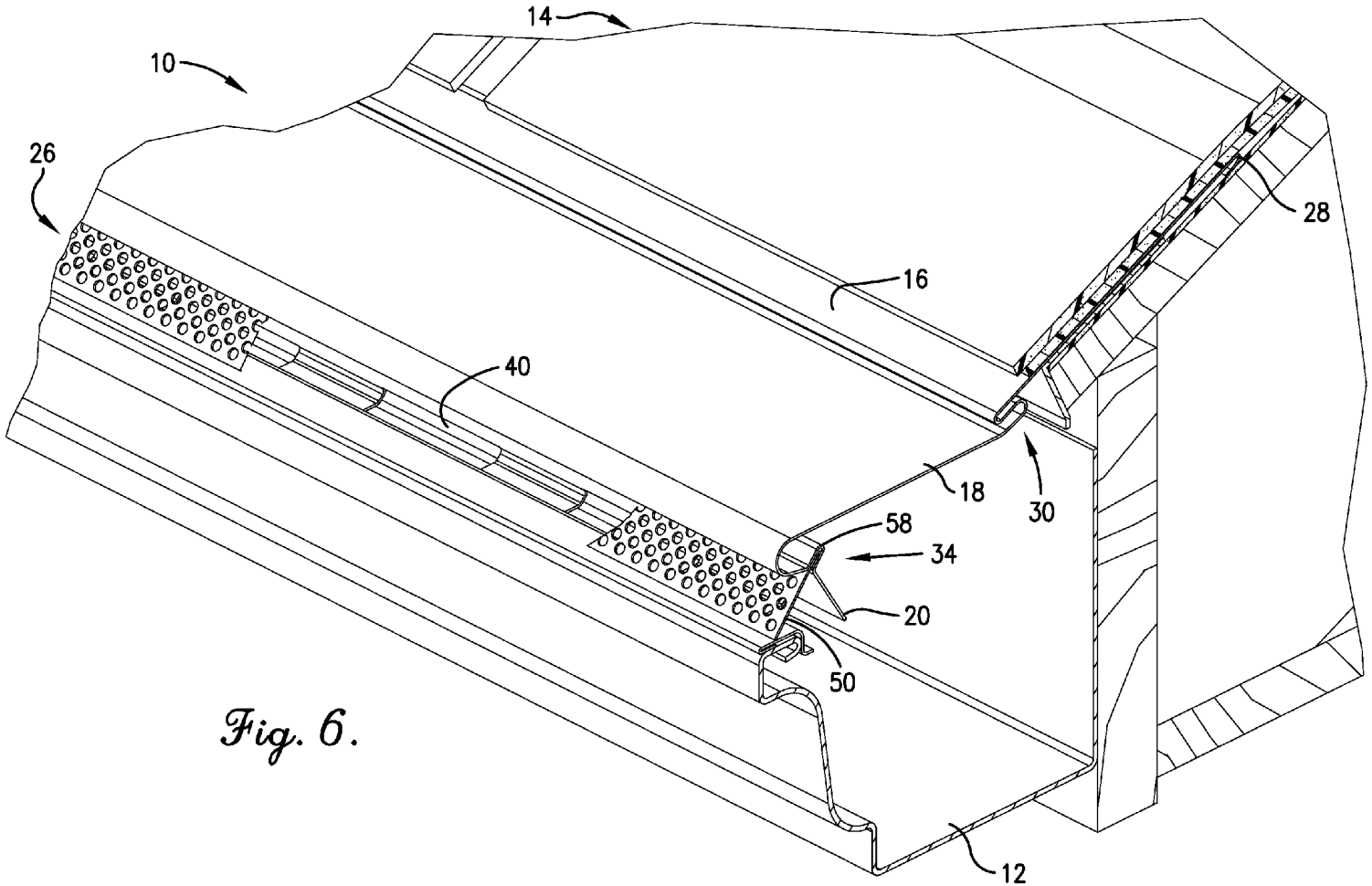
FIG. 6 is a perspective view of the gutter cover shown with the screen installed in the hem that includes a pocket.
Figure 7:
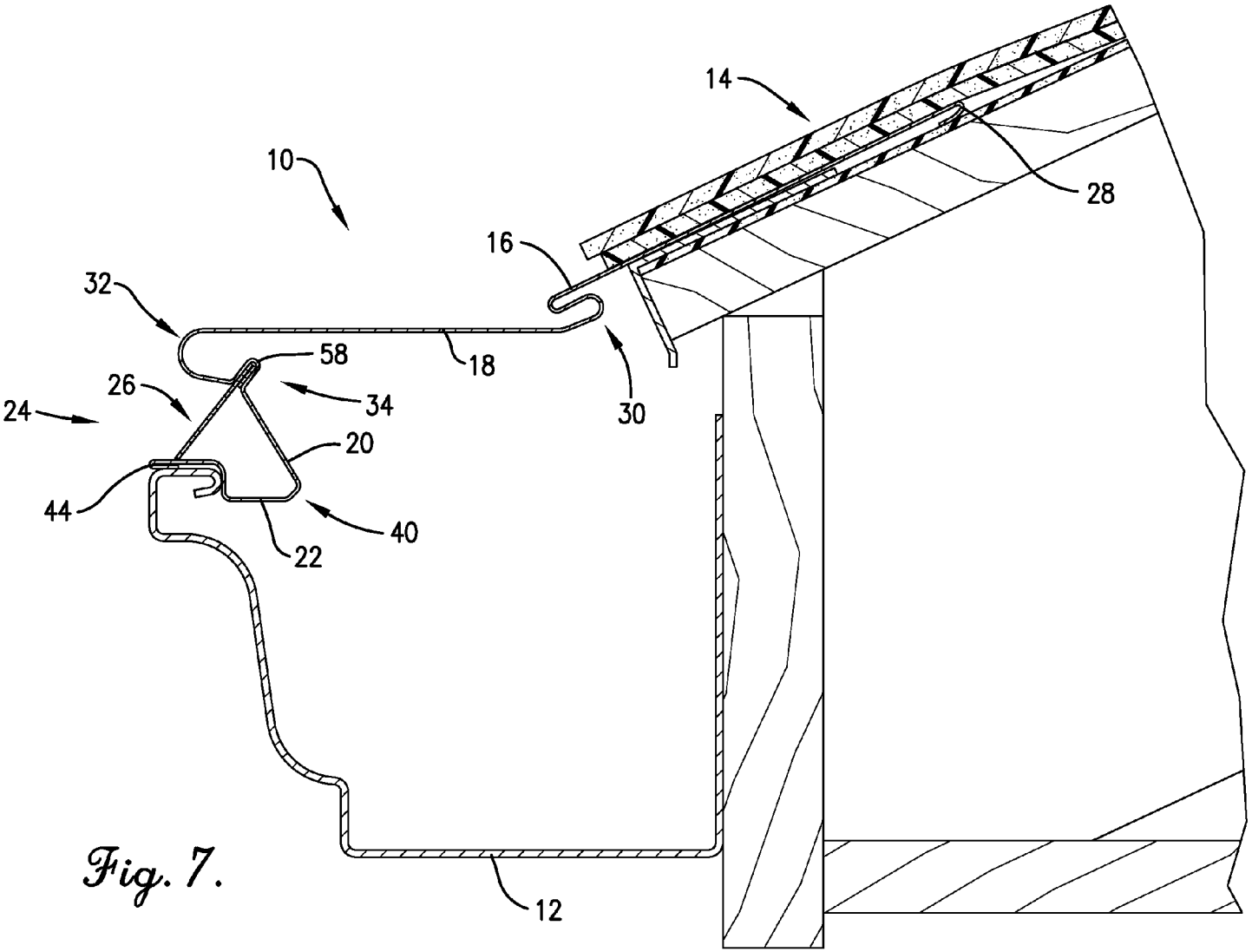
FIG. 7 is a side sectional view of the gutter cover shown with the screen installed in the pocket.

The generally planar fourth section 22 is joined to the third section 20 by a third bend 40. The third bend 40 preferably has an acute angle that, when summed with the angle of the second bend 32, equals approximately 180°, so that the fourth section 22 is generally parallel with the second section 18. That is, the fourth section 22 has a slight downward slope from right to left. For example, the second bend 32 may have an angle of approximately 120° and the third bend 40 may have an angle of approximately 60°. As best illustrated in FIGS. 1, 3, and 6, a series of spaced-apart holes or cutouts 42 are formed in the fourth section 22 that allow water to pass from the gutter cover 10 into the underlying gutter 12.

Each gutter cover 10 segment also includes a leftmost second lip 44 joined to the fourth section 22 to protrude outward away from the roof 14. In various embodiments, the fourth section 22 may sit below the level of the front upper edge of the gutter 12, therefore the second lip 44 may be joined to the fourth section 22 by one or more bends to raise the level of the second lip 44 to match that of the front upper edge of the gutter 12. The second lip 44 may be connected to the front upper edge of the gutter 12 by mounting brackets or other fasteners.

Figure 4:
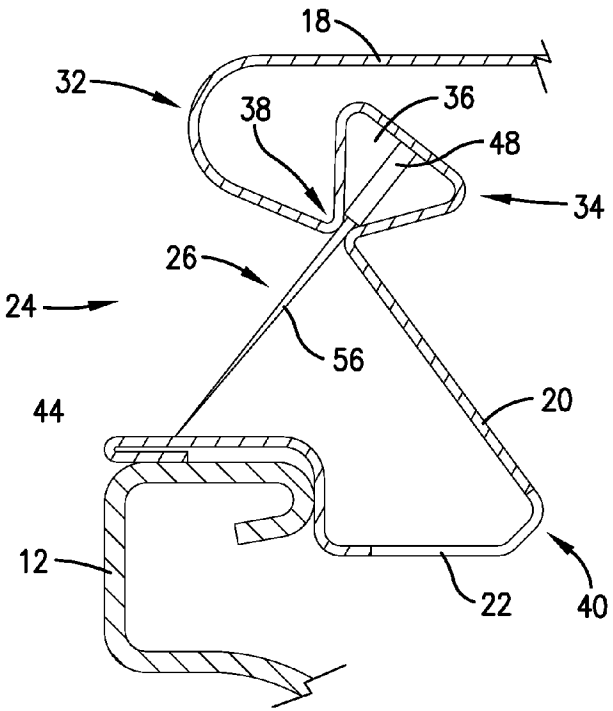
FIG. 4 is a side view of a portion of the gutter cover depicting the comb structure installed in the open-space cavity.
Figure 2:
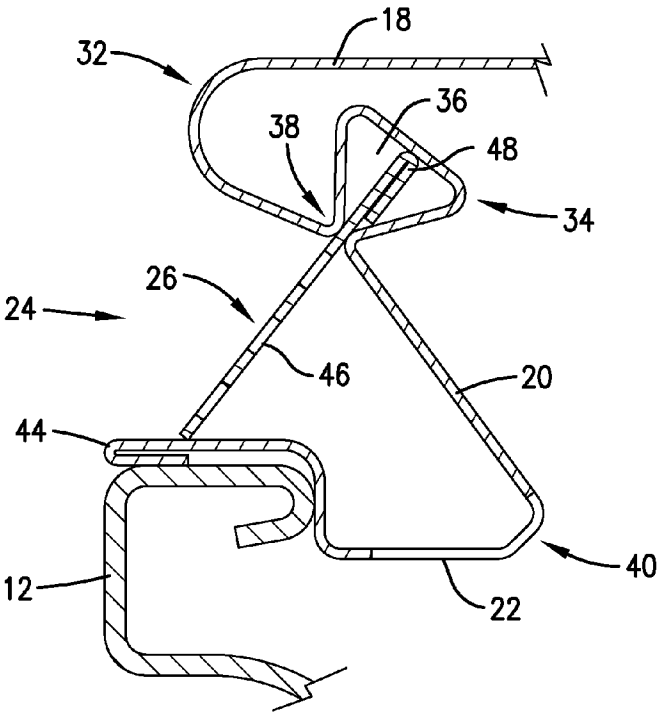
FIG. 2 is a side sectional view of a portion of the gutter cover depicting the screen installed in a hem that includes an open-space cavity.

The water channel 24 may be formed by one or more sections of the gutter cover 10, as best seen in FIGS. 2 and 4. Particularly, the water channel 24 may be formed between the third section 20 and the second lip 44. The water channel 24 may also include the fourth section 22 and the cutouts 42. The water channel 24 generally allows water to flow from the second section 18 to the fourth section 22, where it may exit the gutter cover 10 through the cutouts 42. Thus, as water flows from the roof 14, across the first bend 30 and the second section 18 of the gutter cover 10, the water will flow over the second bend 32 and into the water channel 24, without flowing over the second lip 44 of the gutter cover 10 and onto the ground below.

As illustrated in FIGS. 2 and 4, the barrier 26 is provided to prevent leaves, twigs, and other debris from entering and blocking the water channel 24. The barrier 26 includes a generally elongated body 46 with a plurality of openings that allow water flow through the barrier 26. The body 46 generally possesses a relatively slender cross-sectional thickness. The barrier 26 also includes a crown 48 attached to one end of the body 46 along the length. The crown 48 is of greater cross-sectional thickness than the body 46. The crown 48 may have a generally elongated or elongated rectangular cross-sectional shape. The barrier 26 couples with, and may be installed in, the hem 34 of the third section 20 by inserting the crown 48 into the cavity 36 such that the body 46 of the barrier 26 occupies the gap 38 of the hem 34. The gap 38 is generally narrow enough to hold the body 46 snugly, but is wide enough such that once inserted into the hem 34, the barrier 26 may slide along the length of the third section 20. During this step of installation, it may be necessary to bend the lower portion of the third section 20 back slightly to widen the gap 38 while the body 46 of the barrier 26 is sliding through. When utilizing the cavity 36 to install the barrier 26, the cavity 36 can be reached from the front side of the gutter cover 10. Therefore, access to the rear side of the third section 20 is not necessary. Furthermore, the barrier 26 may include one or more segments to match the one or more segments of the gutter cover 10. Thus, one or more barrier 26 segments may be inserted into the hem 34 and slid along the cavity 36 in order for the barrier 26 to match the length of the gutter cover 10, which in turn matches the length of the gutter 12.

After the barrier 26 is installed in the hem 34 of the third section 20, the barrier 26 covers the opening of the water channel 24, as seen in FIGS. 1 and 3. Hence, the crown 48 is coupled with the hem 34, and the body 46 of the barrier 26 extends from the third section 20 to the second lip 44 of the gutter cover 10, such that the barrier 26 contacts the outer portion of the second lip 44. In various embodiments, the edge of the body 46 may overhang the outer edge of the second lip 44. Once installed, the angle of the barrier 26 may vary to accommodate variations in gutter sizes and configurations, but generally the barrier 26 is angled forward to allow water to flow through but prevent leaves, acorns, or other debris from passing through. Typically, debris is deflected off the barrier 26 entirely and falls to the ground or landscaping below the gutter 12.

In some embodiments, the barrier 26 may include a screen 50 with a plurality of holes 52 along the body 46 that allows water to penetrate the barrier 26 but prevents the passage of debris through the barrier 26, as shown in FIGS. 1 and 2. The barrier 26 may be manufactured from a rigid material, such as hard plastic or aluminum or other metals, with a plurality of holes 52 punched through the material. Alternatively, a wire mesh type screen 50 enclosed within a metal frame may be utilized. The crown 48 portion of the barrier 26 may formed by folding one end of the barrier 26 along its length to create a lip or a ridge. The crown 48 may also be formed from an enlarged portion of a frame, or by molding or otherwise attaching a wider portion of material to one end of the barrier 26 along its length. The barrier 26 of this embodiment may be installed into the hem 34 as described above.

Figure 5:
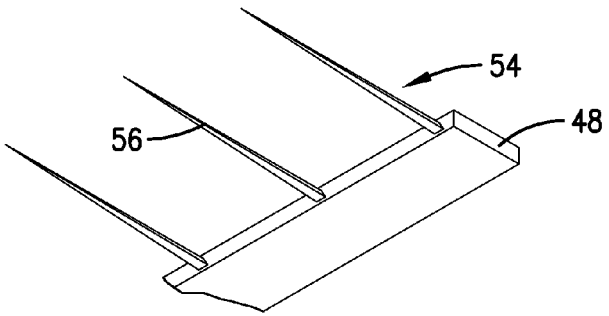
FIG. 5 is a perspective view of a portion of the comb structure.

In other embodiments, the barrier 26 may include a comb structure 54, as illustrated in FIGS. 3-5. The body 46 of the comb 54 may include a plurality of elongated spaced-apart, forwardly-protruding teeth 56 that allow water to penetrate the barrier 26 but prevent the passage of debris through the barrier 26. The teeth 56 may be attached to the crown 48 transverse to the length of the barrier 26. The barrier 26 may be formed from various types of plastic and generally molded in the shape of a comb. Other materials, such as metals, may be used to form the comb structure 54, such that the teeth 56 are rigidly attached to the crown 48. The teeth 56 may include a generally triangular cross-sectional shape along the length of each tooth 56, wherein the broad portion of each tooth 56 is attached to the crown 48 and the other end of the tooth 56 tapers to a point. The triangular cross section of each tooth 56 encourages the water that might try to flow along the length of the tooth 56 to fall into the water channel 24 before the water reaches the end of the tooth 56. The barrier 26 of this embodiment may be installed into the hem 34 as described above.

In another embodiment, the hem 34 of the third section 20 may not include an open-spaced cavity but instead may include a pocket with a generally U-shaped cross section, as depicted in FIGS. 6-10. The pocket may be formed by bending or otherwise manipulating the third section 20 to create two relatively short walls 60, 62 joined by a bight section and generally parallel to one another with a space between.

Figures 8, 9:
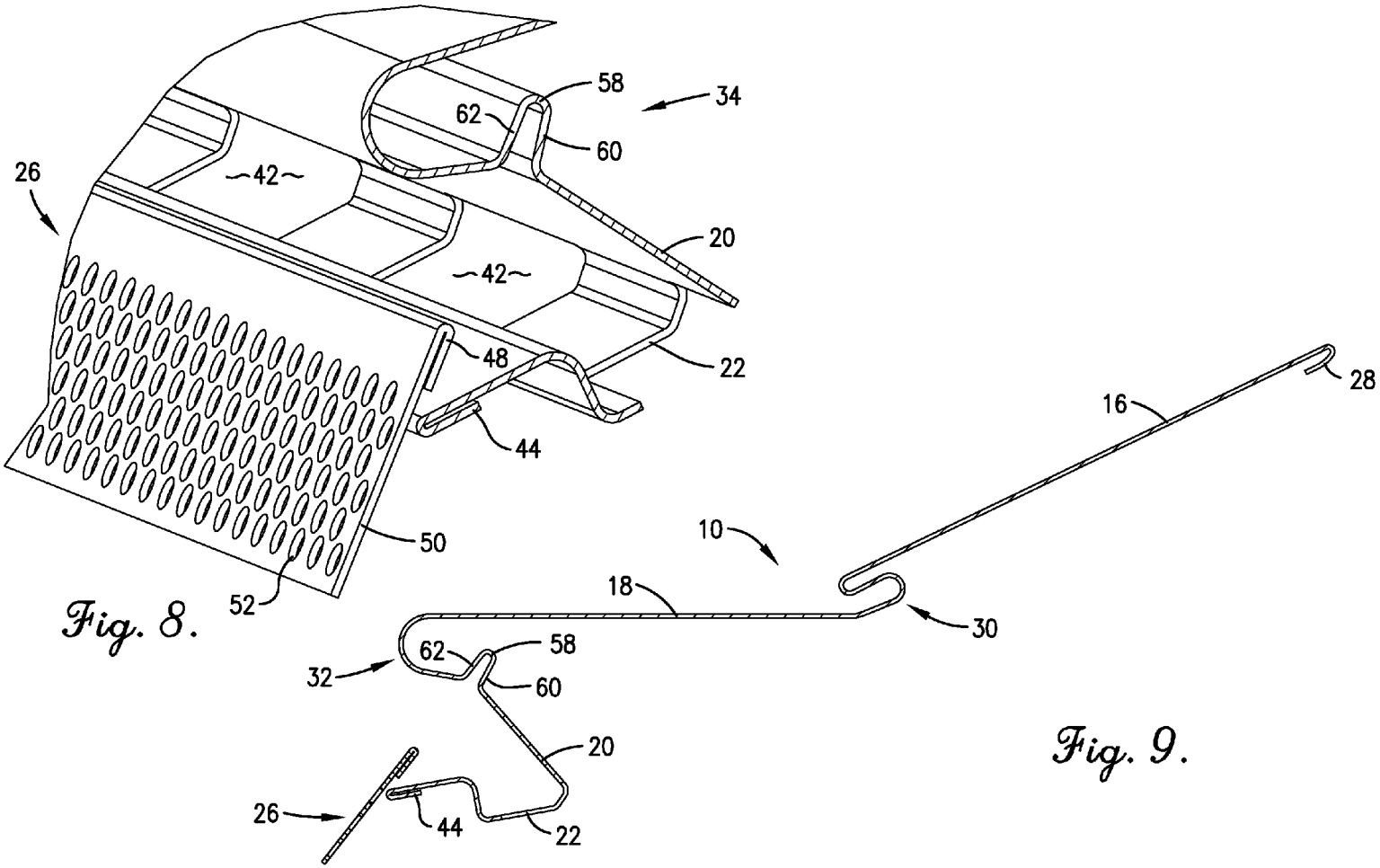
FIG. 8 is a perspective view of a portion of the gutter cover shown with the screen before it is installed in the pocket.
FIG. 9 is a side sectional view of the gutter cover shown with the screen before it is installed in the pocket.
Figure 10:
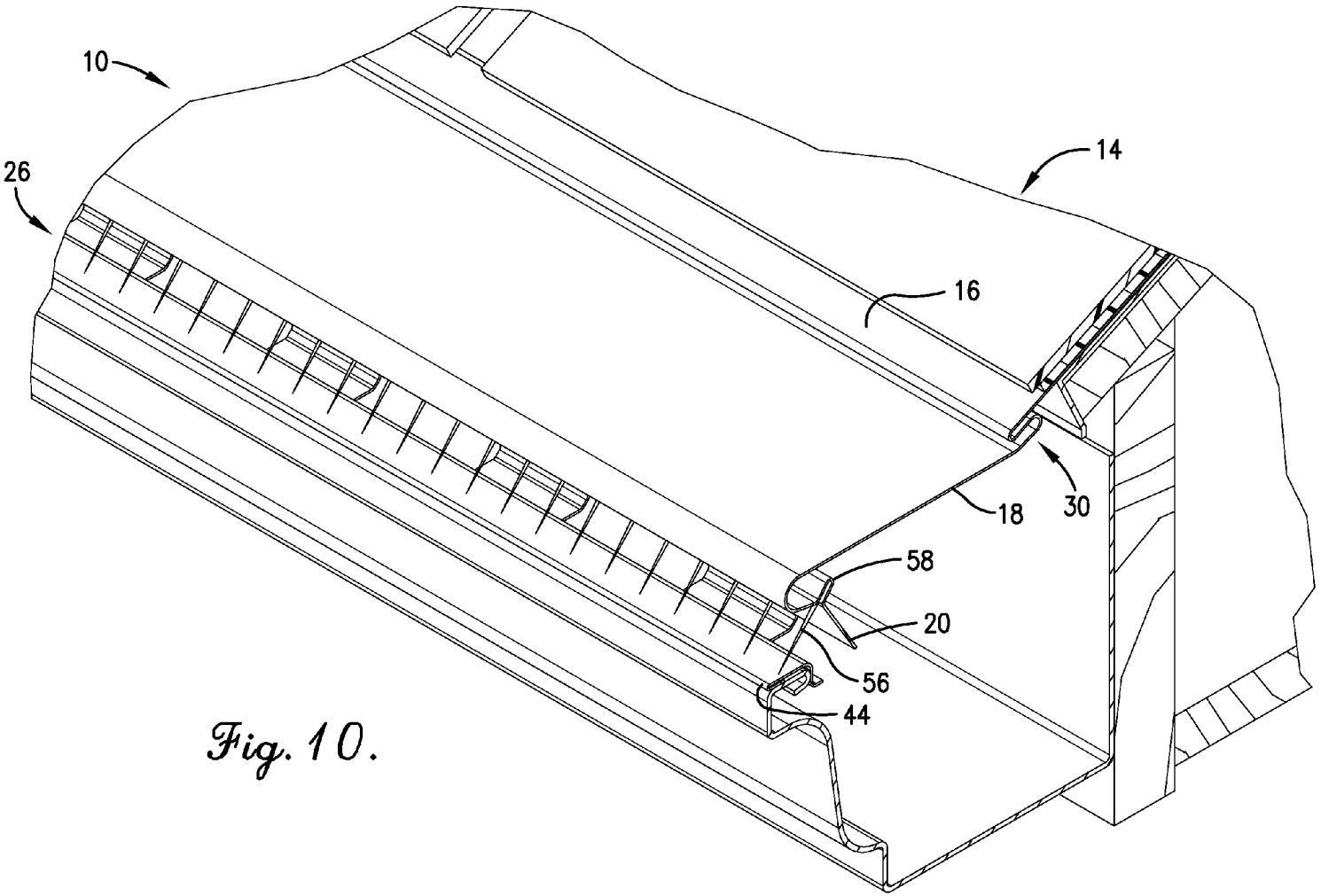
FIG. 10 is a perspective view of the gutter cover shown with the comb structure installed in the pocket.

The barrier 26 may be inserted into the pocket 28 by bending the third section 20 to temporarily widen the space between the two walls 60, 62, shown in FIGS. 8 and 9. The crown 48 of the barrier 26 is inserted directly into the pocket 28 from the transverse direction, and the third section 20 is bent in the opposite direction to close the gap 38 between the two walls 60, 62 so as to firmly hold the barrier 26 in the pocket of the hem 34. The barrier 26 may be easily removed by reversing these steps. With this embodiment of the hem 34, both of the embodiments of the barrier 26 discussed above may be utilized.

Figure 11:
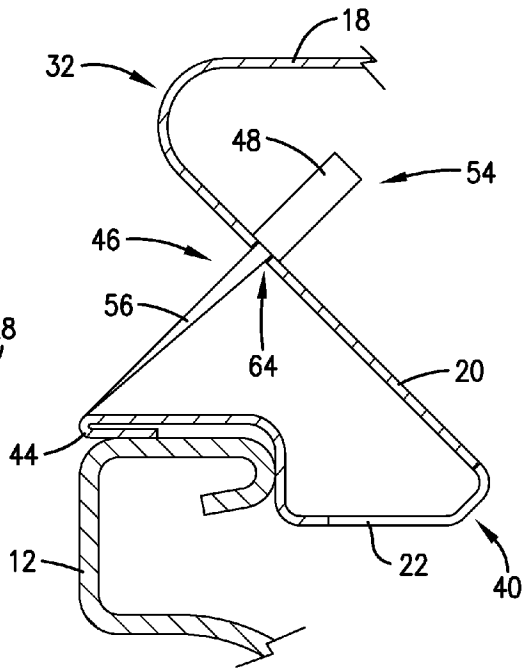
FIG. 11 is a side sectional view of a portion of the gutter cover depicting an embodiment in which the comb structure is installed through a plurality of holes in a section of the gutter cover.

In another embodiment of the gutter cover 10, the third section 20 of the gutter cover 10 may not include the hem 34 at all. Instead, the third section 20 may include a plurality of longitudinally spaced apart holes 64 to form a row of holes, seen in FIGS. 11-13. The holes 64 may be drilled or punched through the third section 20 parallel to the longitudinal axis. The holes 64 may be located just below the second bend 32 of the gutter cover 10 or closer to the third bend 40. The location of the holes 64 may be varied to accommodate variations in the dimensions of the third section 20, the fourth section 22, and the second lip 44. With this embodiment of the third section 20, the barrier 26 in the shape of the comb 54, as described above, may be utilized. The pitch of the holes 64 in the third section 20 may match the pitch of the teeth 56 of the comb 54. The shape and size of each hole may match the shape and size of each tooth 56 of the comb 54 where the tooth 56 is attached to the crown 48 to ensure a snug fit when the barrier 26 is installed in the third section 20.

Figure 12:
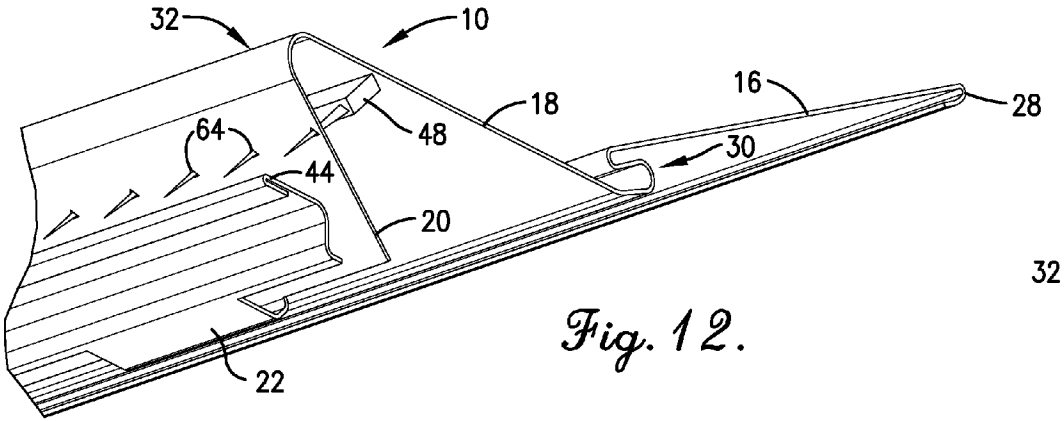
FIG. 12 is a perspective view of the gutter cover depicting the embodiment in which the comb structure is partially installed through the plurality of holes in the section of the gutter cover.
Figure 13:
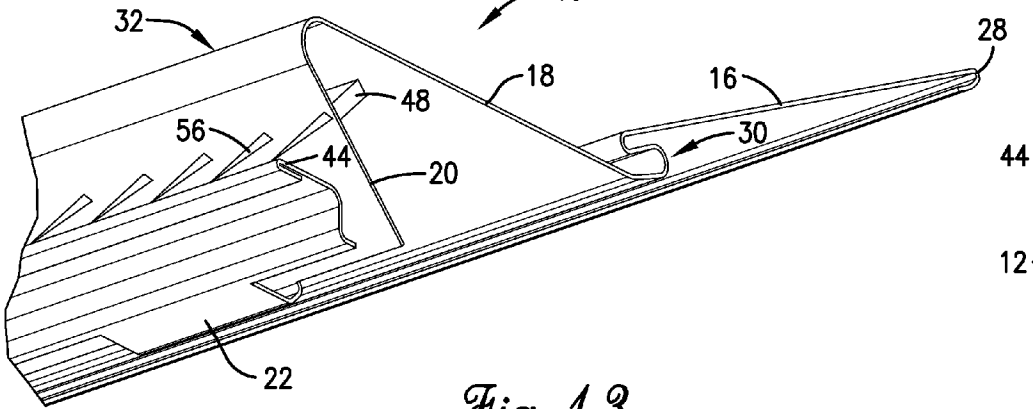
FIG. 13 is a perspective view of the gutter cover depicting the embodiment in which the comb structure is fully installed through the plurality of holes in the section of the gutter cover.

The barrier 26 may be installed by aligning the teeth 56 of the comb 54 with the holes 64 of the third section 20 on the rear side of the third section 20. The teeth 56 are pushed through the holes 64 until the crown 48 contacts the rear side of the third section 20, as shown in FIGS. 12 and 13. Generally, the frictional force between the teeth 56 and the holes 64 of the third section 20 holds the barrier 26 firmly in place. However, in various embodiments at least a portion of the teeth 56 may include a flanged or slightly enlarged portion that is spaced away from the crown 48. This flanged portion may act as a lock to hold the barrier 26 in place once it has been installed through the third section 20.

The function of this embodiment of the third section 20 and the barrier 26 is substantially similar to the embodiments described above. The comb-shaped barrier 26 allows water to flow freely through the barrier 26 and into the channel 24 where the water can flow through the cutouts 42 and into the gutter 12. However, the comb-shaped barrier 26 deflects debris such as leaves or acorns so that this debris cannot enter the channel 24.

The barrier 26 of the various embodiments disclosed herein installs with the third section 20 of the gutter cover 10 generally without the use of extra components, such as screws, nails, pop rivets, or the like. Furthermore, the coupling of the barrier 26 to the third section 20 does not impede the flow of water from the gutter cover 10 into the gutter.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A gutter cover for covering a gutter attached to a building below a roof, the gutter cover comprising:

a first section installed over or under roofing material covering the roof for directing water from the roof;

a second section attached to the first section by a first bend and installed at least partially over an open end of the gutter;

a third section attached to the second section by a second bend such that the third section extends generally downward and inward, the third section including a plurality of longitudinally spaced apart holes;

a fourth section attached to the third section by a third bend, the fourth section including a lip protruding away from the roof to engage the front, upper edge of the gutter;

a water channel formed between the third section and the lip to allow water to flow from the second section to the fourth section; and a comb-shaped barrier including an elongated crown to which a plurality of forwardly-protruding bars are attached, wherein the bars are inserted through the plurality of holes of the third section such that the barrier is positioned at the opening of the water channel to allow water to pass into the channel but to block debris from entering the channel.

2. The gutter cover of claim 1, wherein the fourth section includes a plurality of longitudinally spaced apart cutouts to allow water to pass from the gutter cover to the gutter.

3. The gutter cover of claim 1, wherein each of the bars includes a triangular-shaped cross section, such that one end of the bar that is attached to the crown is broad and the opposing end of the bar tapers to a point.

4. A gutter cover system for covering a gutter, the system comprising:

a gutter cover for partially covering a gutter, the gutter cover and the gutter having a channel therebetween for directing water from the gutter cover into the gutter, the gutter cover including a hem with an open-spaced cavity and a lengthwise gap coupled thereto, wherein the cavity is of greater cross-sectional width than the gap; and a barrier covering the channel to allow water to enter the channel but to prevent debris from passing through the barrier and entering the channel, the barrier retained within the gap and including a lengthwise edge positioned within the cavity.

5. The gutter cover system of claim 4, wherein the barrier is slidably retained within the gap.

6. The gutter cover system of claim 4, wherein the edge includes an elongated crown which is held within the cavity.

7. The gutter cover system of claim 6, wherein the crown is of greater thickness than the rest of the barrier.

8. The gutter cover system of claim 4, wherein the barrier includes a screen manufactured from a rigid material with a plurality of holes that allows water to penetrate the barrier but prevents the passage of debris through the barrier.

9. The gutter cover system of claim 4, wherein the barrier includes a comb structure with a plurality of elongated spaced-apart, forwardly-protruding teeth that allow water to penetrate the barrier but prevent the passage of debris through the barrier.

10. A gutter cover for covering a gutter attached to a building below a roof, the gutter cover comprising:

a first section installed over or under roofing material covering the roof for directing water from the roof;

a second section attached to the first section by a first bend and installed at least partially over an open end of the gutter;

a third section attached to the second section by a second bend such that the third section extends generally downward and inward, the third section including a hem;

a fourth section attached to the third section by a third bend, the fourth section including a lip protruding away from the roof to engage the front, upper edge of the gutter;

a water channel formed between the third section and the lip to allow water to flow from the second section to the fourth section; and a barrier coupled with the hem of the third section such that the barrier is positioned at the opening of the water channel to allow water to pass into the channel but to block debris from entering the channel, the barrier including a comb structure with a plurality of elongated spaced-apart, forwardly-protruding teeth that allow water to penetrate the barrier but prevent the passage of debris through the barrier, wherein each tooth includes a length-wise triangular-shaped cross section, such that one end of the tooth that is coupled with the hem is broad and the opposing end of the bar tapers to a point.

* * * * *